United States Patent [19]

Baker et al.

[11] 4,389,242

[45] Jun. 21, 1983

[54] INTERIOR ARRANGEMENT FOR DIRECT REDUCTION ROTARY KILNS AND METHOD

[75] Inventors: Alan C. Baker, Harriman, Tenn.; Geoffrey N. Boulter, New York, N.Y.; Daniel H. Wilbert, Knoxville, Tenn.

[73] Assignee: The Direct Reduction Corporation, New York, N.Y.

[21] Appl. No.: 359,439

[22] Filed: Mar. 18, 1982

[51] Int. Cl.[3] ..... C21B 13/08; F27B 7/30

[52] U.S. Cl. ..... 75/20 R; 266/173; 266/248; 75/36; 75/29

[58] Field of Search ..... 266/173, 248; 75/36, 75/20 R, 29

[56] References Cited

U.S. PATENT DOCUMENTS 2,039,645 5/1936 Hechenbleikner ..... 266/173

4,273,314 6/1981 Keran et al. ..... 266/173

*Primary Examiner*—M. J. Andrews

*Attorney, Agent, or Firm*—Cooper, Dunham, Clark, Griffin & Moran

[57] ABSTRACT

A method and means for maximizing the use of the kiln capacity in a rotary kiln, directly reducing metal oxides using solid carbonaceous materials as the source of fuel and reducant, is disclosed involving the creation of an annular dam arrangement within the kiln at a selected position between the feed end and the discharge end dams, which arrangement is located and dimensioned with respect to the end dams, such that the materials in the charge bed suitably fill the kiln volume and have sufficient residence time in the feed end portion of the kiln, to permit adequate heat transfer thereto, thus minimizing the portion of the kiln needed for preheating and maximizing the remaining portion of the kiln available for reduction. In a kiln of a given size, the spacing and dimensions of the end dams and one or more intermediate dams are designed in combination with the degree of kiln inclination, the kiln rotational speed and the required heat transfer rate to the surface of the charge bed to obtain a volume filling in the charge bed in the preheat zone, and hence a solids residence time therein, which is optimum so that the mass flow rate and the degree of metallization of the metal oxides may be maximized for the available kiln volume.

10 Claims, 2 Drawing Figures

PREHEAT ZONE
21
23a
23b

FEED MATERIALS
4
5
EXHAUST GASES
FEED END
KILN
6
23
21
30
9
9a
10
31
1
5a
AIR
6a
SPILL BACK
PREHEAT ZONE
TRANSITION REGION
REDUCTION ZONE
WORKING ZONE
DISCHARGE END
22
8
7
6b
DISCHARGE MATERIALS

INTERIOR ARRANGEMENT FOR DIRECT REDUCTION ROTARY KILNS AND METHOD

BACKGROUND OF THE INVENTION

The present invention relates to the direct reduction of metal oxides in rotary kilns using solid carbonaceous materials as the source of fuel and reductant, and more particularly to a method and means for constructing the kiln interior to maximize the kiln output for a given volume kiln.

The interior of a direct reduction rotary kiln may be divided essentially into two operating zones, a preheat zone at the kiln feed end, wherein the materials entering the charge bed are preheated to bring them up to a temperature level at which reduction will begin, and a reduction zone, wherein the metal oxides are actually reduced to a metallic state before passing out of the kiln discharge end. The heat transfer requirements from the burning freeboard gases to the charge bed in the two zones differ substantially since in the preheat zone the need is primarily for sensible heat to raise the bed temperature to the threshold level for reduction, while in the reduction zone the reactions bringing about reduction are strongly endothermic, and create an added heat demand which varies along the length of the charge bed. The amount of heat transfer to the bed in the reduction zone therefore must generally be much higher than in the preheat zone to achieve a high level of metallization. Accordingly, to maximize the use of the kiln volume, it would seem desirable to maintain a high temperature throughout the kiln for a rapid preheating of the charge in the preheat zone, particularly when the feed materials are fed at ambient temperature, and for accelerated and maximum reduction of the oxides in the reduction zone. However, problems are presented when attempting this approach by various phenomena which occur in the charge bed. For example, when the metal oxides used are those in iron ore, rapid increases in bed temperatures in the preheat zone can cause excessively rapid phase changes in the metal oxides from hexagonal crystal hematite to cubic crystal magnetite and excessive decrepitation of the ore. Also, rapid heat up may cause the formation of sticky phases in the bed in the transition region of the kiln just beyond the preheat zone. These phases can result in sintering and uncontrolled accretion formation on the kiln walls in the transition region. Further, if certain coals are used as the carbonaceous material, rapid heat up may plasticize the coal, thereby retarding mixing of the materials in the charge bed. Consequently, the temperature levels in the kiln and heat transfer to the bed must be carefully controlled to produce and maintain a suitable temperature profile in the charge bed that will permit optimum metallization of the metal oxides while avoiding charge decrepitation, sintering, wall accretions, and other deleterious effects. A particular temperature profile for this purpose is described in U.S. Pat. No. 4,304,597, assigned to the same assignee as the present invention.

It, therefore, appears that a gradual bed temperature increase is desirable; but, unfortunately, in a kiln of a given volume, if the temperature of the charge bed in the preheat zone is brought up gradually to avoid the previously-mentioned deleterious effects, too much of the kiln volume may be used in preheating, leaving insufficient volume for the reduction zone. This will result in a low kiln output for the total operating volume of the kiln, or, in other words, inefficient operation. An actual example of such a situation is described in the ISS-AIME Ironmaking Proceedings, Volume 35, St. Louis, 1976, pp. 396–405.

To solve this latter problem, prior art solutions have included heating of the charge materials prior to feeding them to the kiln and mechanically complex techniques for rapid preheating of the charge in the kiln, such as by the use of under-bed combustion-air injection. These solutions nevertheless do not greatly decrease the risk of kiln accretions or ringing in the transition region at the start of the reduction zone, the region of the kiln which, in the absence of proper heat transfer or bed temperature control, is the most susceptible to ringing.

The present invention provides a solution to the problem of properly transferring an adequate supply of heat to the charge bed in the preheat zone of the kiln by utilizing the intermediate interior dam, used in some direct reduction and certain other process kilns, in an improved manner. This solution obviates the need for prior heating of the charge outside of the kiln, complicated rapid preheating techniques, or excessive gas temperatures, by maximizing the degree of kiln volume filling and charge residence time and, consequently, the product throughput in a kiln of a given volume.

SUMMARY OF THE INVENTION

The present invention involves the design and installation of a dam arrangement comprising one or more intermediate dams, preferably formed as part of the refractory lining, in the interior of a direct reduction rotary kiln. The location of the dam arrangement and its dimensions with respect to the kiln feed end and discharge end dams are selected to provide the necessary volume filling and retention time of the charge bed materials in the preheat zone to permit sufficient heat transfer to the bed in that zone for smooth charge temperature elevation and thus the avoidance of undesirable ore decrepitation, charge sintering and wall accretions in the transition region at the beginning of the reduction zone. The intermediate dam arrangement is positioned in a kiln of a given volume taking into consideration the compositions and desired mass flow rates of the raw materials and their specific heats as well as the endothermic heat requirements to estimate the required rate of heating in the preheat zone and accordingly the volume filling required to essentially define the preheat zone and separate it from the reduction zone. The heights of the feed end, discharge end and intermediate dams are then selected, along with the kiln inclination and rate of rotation, to create charge bed depths in the kiln that allow sufficient residence time to permit the required amounts of heat at the expected heat transfer rates to be transferred to the bed materials in a controlled manner, and particularly to minimize the portion of the kiln needed for the preheat zone and thus to maximize the remaining portion of the kiln available for reduction. The resulting enhancement of the control of heat transfer to the charge bed permits a degree of metallization of the materials being reduced and a mass flow rate that are maximum for the volume of the kiln being used for the process.

DETAILED DESCRIPTION OF THE PREFERRED EMBODIMENT

Figures 1, 2:
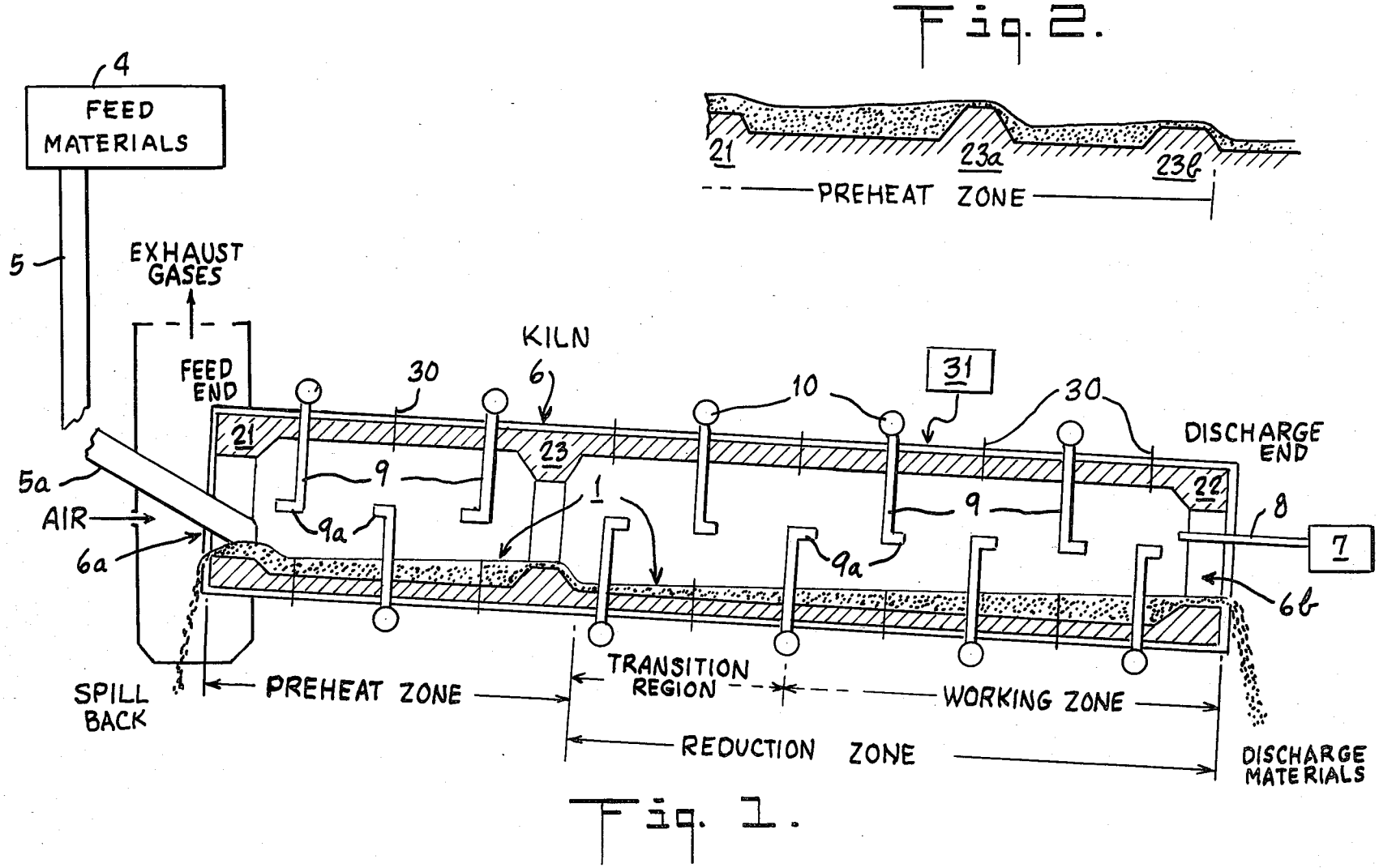
FIG. 1 is a diagram of a direct reduction system including a view in section of a rotary kiln incorporating and illustrating an intermediate dam arrangement in accordance with the present invention.
FIG. 2 is a view in section of a portion of a kiln interior illustrating a modification of an intermediate dam arrangement in accordance with the present invention.

The system shown in FIG. 1 is of the type in which the present invention is intended for use and is particularly suitable for reducing metal oxides, typically iron oxides contained in iron ore. The metal oxides are fed in the form of pellets or natural lump ore or other physical forms into the feed end of rotary kiln 6 and are reduced therein by using solid carbonaceous materials, such as coal, as the source of fuel and reductant, which materials are fed into the kiln from both the feed end and the discharge end. The feed end carbonaceous materials are fed with the metal oxides and other charge materials, such as desulfurizing agent in the form of limestone or dolomite, from appropriate supply sources 4, by conventional weigh feeder conveying means 5 and an inclined chute 5*a*, through an opening 6*a* in the feed end of the kiln 6. All the feed end materials enter the kiln, conveniently at ambient temperature, and form a charge bed 1 between a feed end dam 21 and a discharge end dam 22, both typically formed annularly as part of the refractory lining 20 of the kiln. The charge materials in the bed 1, by virtue of the preselected slope or inclination of the kiln and its rotation, move progressively along the kiln length to the discharge end.

The discharge end carbonaceous materials, in the form of coal and/or recycled char and the like, are injected onto the surface of the advancing bed 1 through an opening 6*b* in the kiln discharge end, out of which opening the kiln product is discharged over dam 22. These materials, which also may be fed at ambient temperature, are preferably injected by blowing with a low pressure air source 7 through a pipe 8, in a manner and by means such as described in U.S. Pat. No. 4,306,643 and co-pending U.S. application Ser. Nos. 266,602 and 317,939, all assigned to the same assignee as the present application.

The reduction process is begun by initially igniting the carbonaceous materials in the kiln and then continuing the combustion by the injection of an oxygen-containing gas, such as air, drawn in from outside the kiln through tubes 9 passing through the kiln shell and having injection nozzles 9*a* for directing the injected gas axially within the kiln. Each of the air tubes 9 may be provided externally with a fan 10 that is individually controllable to permit the air injection all along the kiln to be closely regulated so that the combustion of the gases arising from the bed, and thus heat transfer to the bed, can be varied in the different regions.

Fixed thermocouples 30 may be provided along the kiln length to sense the gas and bed temperatures and provide an appropriate indication through which the average temperature profiles within the kiln can be monitored and adjusted to optimize process operation. In addition to the fixed thermocouples 30, a roving, fast-response thermocouple 31 may be used selectively, by manual insertion into appropriate ports along the kiln, to detect the immediate gas and bed temperatures at particular locations during kiln rotation.

The process operating zone within the kiln interior, as indicated in FIG. 1, consists of two regions, a preheat zone at the feed end wherein the solids bed of charge materials is increased in temperature, typically from ambient, to bring it up to a level approaching that at which the reduction of the metal oxide materials begins, and a reduction zone beginning at the end of the preheat zone and continuing to the discharge end of the kiln. In the reduction zone the metallization of the metal oxides is carried out by complex gas/solid reactions that are strongly temperature dependent for a given production rate of metal. As the reduction reactions are highly endothermic, high operating temperatures with attendant high heat transfer to the bed are normally desirable in the reduction zone. However, the overall use of high temperatures is limited by the occurrence of sintering in the bed brought on by reactions in the bed constituents at high temperatures. High temperatures may also result in uncontrolled accretion formation on the kiln walls as well as other deleterious effects such as the production of sulfur bearing compounds in the bed. These effects occur primarily in the initial portion of the reduction zone so that the bed temperatures must be carefully controlled in this transition region. By the time the bed materials reach the latter portion of the kiln length rapid and complete reduction is occurring so that in that region, called the working zone, the highest operating temperatures are permissible and desirable. Consequently, the temperature levels in and heat transfer to the bed must be carefully controlled to maintain a temperature profile in the solid charge materials that will maximize the amount and rate of metallization while avoiding sintering and other deleterious effects. However, the actual transition points or demarcation lines between the various zones are not easily determinable and will vary with the bed constituents or materials being used in the process. A method and means for determining or defining the end of the preheat zone and beginning of the reduction zone and for minimizing the length of the former to maximize the length of the latter in accordance with the present invention will now be described.

In designing a kiln of the type shown, to begin with the desired product capacity of the kiln is chosen in terms of the annual tonnage of metal to be produced by the kiln. Then, based on the selected capacity a necessary volume is determined, that is, the total internal kiln volume that will be required to achieve the product capacity, which volume is dependent upon the mass flow rates of the constituents involved and particularly on the estimated volume of gases that must be handled. The kiln diameter is established by using the internal kiln volume figure and the estimated velocity of the gases that must pass through and out of the kiln to determine the cross-sectional area necessary. With the cross-sectional area established, the diameter can be easily calculated. With a diameter value, the length of the kiln is calculated using the conventional length to diameter (L/D) relationship, typically of a magnitude between $14\frac{1}{2}$ and $17\frac{1}{2}$, and taking into account the residence time the constituents will need in the kiln depending upon the heat flux or heat transfer required and the gas velocity. Following from the length and diameter of the kiln, the slope or inclination at which the kiln will be mounted for rotation is determined in order to roughly maximize the volume of the charge bed that can be retained within the kiln during operation of the process. In this latter regard, the height of the discharge end dam 22 is selected to maximize the degree of filling or bed size and the residence time of the materials in the kiln reduction zone.

Having thus broadly established the major structural design parameters of the kiln, process considerations and particularly the heat transfer requirements to the charge bed incrementally along the length of the kiln must be taken into account to refine and complete the design. Again, it is important to consider that the heat demand in the charge bed along the kiln during process operation differs substantially, ranging from the moderate heat required in the preheat zone to gently raise the temperature level of the materials in the bed, to the considerably higher quantities of heat needed to produce the comparatively high bed temperatures in the reduction zone. Further, as previously noted, high heat transfer in the transition region between the preheat zone and the reduction zone can raise the bed temperatures to a level that will cause sintering and other deleterious effects and so must be avoided. To achieve the proper temperature profile in the bed, therefore, without the occurrence of sintering, the feeding of the combustion air from tubes 9 along the kiln should be regulated to bring the temperature of the kiln bed gradually upwards from the preheat zone to the reduction zone. However, a problem encountered in accomplishing such a controlled temperature increase is that unless the charge materials are heated before entering the kiln or some means is provided to rapidly increase the temperature of the charge from ambient at the feed end, it may be found that an unacceptably long portion of the kiln volume is required for the preheat zone in order to transfer a sufficient amount of heat to the charge bed to bring about the necessary temperature transition. Under such circumstances the reduction zone will be correspondingly shortened, unless the kiln length is redesigned, and the kiln output capacity may become unacceptably low with respect to the kiln size.

The foregoing problem is solved, in accordance with the present invention, without prior heating or auxiliary rapid heating means, by the proper utilization of one or more intermediate interior dams of the type presently used in a number of direct reduction and other rotary kilns. Briefly, an annular intermediate dam arrangement, such as dam 23, is formed in the kiln interior and positioned and dimensioned to essentially separate the preheat zone from the reduction zone and increase the volume filling and accordingly the residence time of the charge materials in the bed in the preheat zone so that for a given heat transfer rate the amount of heat transferred to the materials may be significantly increased in a controlled manner to bring them to the temperature needed for reduction. The heights and dimensions of the discharge end dam 22 and the feed end dam 21 may be adjusted with respect to those of the intermediate dam 23 to maximize the use of the kiln volume in performing the process.

More particularly, in determining the position and dimensions of the intermediate dam 23, it is firstly taken into consideration that for the efficient use of the kiln volume approximately the first third of the kiln should be given over to preheating the charge. Accordingly, the intermediate dam should be formed somewhere in the region about a third of the kiln length from the feed end. Also, The height of the dam will be a function of the cross-sectional area needed to pass the estimated volume of gases that must be handled and the longitudinal inclination of the kiln shell.

In initially estimating and setting the location of the dam, the analysis may be carried out as follows. The known properties of the raw materials to be processed are considered, their specific heats and their desired mass flow rates, and the required rate of heating in the preheat zone is calculated for the available charge volume filling in the zone in the absence of the dam. The calculated heat transfer rate is then compared with the heat available from the gas flow above the bed in the zone and the difference determines the increase in the volume of the charge required in the preheat zone to provide an adequate residence time. The intermediate dam location may then be selected based on the required volume and taking into account the maximum permissible height. Preferably the location is selected to be as close to the feed end as feasible to maximize the length of the reduction zone.

In this regard, it will be seen that the optimum positioning of the dam within the selected region will be dependent to a large extent on the constituents to be used in the process, since the amount of heat to be transferred per unit of mass and the volume required will vary as a function of the combinations of materials to be used in the process. Consequently, the actual building of a dam in the refractory of a given kiln may have to involve a compromise as to positioning if various process runs are to be conducted in the kiln with different metal oxides and carbonaceous materials.

With the location of the intermediate dam arrangement established, there will then be a defined separation of the preheat and reduction zones in the kiln, that is, a readily identifiable place in the kiln indicating where metallization of the metal oxides is actually beginning.

Once the location has been selected, the height of the intermediate dam 23 must then be estimated and set based upon the volume of bed necessary to accomplish appropriate preheating of the charge. The relative heights of the feed end and discharge end dams 21 and the kiln inclination may be adjusted accordingly during this exercise.

An important factor which must be taken into consideration in determining the height and other dimensions of the dam 23, as well as its location, is the actual mechanics of heat transfer or heat flow between the gas and the charge bed, which flow occurs through the surface of the bed at the gas/bed interface. Firstly, for a given combination of constituents, the amount of heat per unit of mass that must be transferred to the bed is the same irrespective of the area of the surface through which it is transferred. The surface area of the bed available for heat transfer in a particular kiln will clearly depend upon the size of the kiln and it will be appreciated that, during design, as the kiln size is increased, that is, the kiln diameter, the available volume for the charge bed will be increased. However, while the mass of materials capable of being retained in the larger volume kiln bed will increase roughly in proportion to the cube of the kiln diameter, the area through which the heat is transferred to this mass, that is primarily the surface area of the bed exposed to the hot gas, will increase only in proportion to the square of the diameter. Consequently, as the size of the kiln is scaled up in design, the ability to provide for adequate heat transfer to the bed, in the absence of the intermediate dam, becomes a greater and greater problem.

The intermediate dam is used to overcome this problem by two effects. Firstly, the increase, due to the dam, in the total charge volume available in the preheat zone to accommodate the greater hourly mass flow of charge feed in a larger kiln, increases the hours of residence time of such charge in this zone so that although the rate of radiant heat transfer per hour may remain unchanged as compared to a smaller kiln, the total quantity of heat transferred to the charge increases to supply the additional quantity required to preheat adequately the greater mass flow of charge. Secondly, since the total charge cross-section occupies a sector of the circular interior of the preheat zone and the depth of the charge is increased by the intermediate dam, the actual area of charge surface available to receive the heat transfer is also increased. This increase in surface area causes the required level of heat flux (Gigacalories of heat transferred per hour per square meter of charge surface) in the preheat zone to be decreased, while the hourly quantity of heat needed to preheat the hourly mass flow of charge remains the same.

An illustrative example is as follows:

| Parameters | Units | Quantities |
|---|---|---|
| Internal refractory diameter of kiln | Meters | 5.0 |
| Nominal production capacity of directly reduced iron (DRI) | Metric tons per year | 215,000 |
| Hourly equivalent iron oxide ore feed | Metric tons | 39.5 |
| Corresponding total heat requirement in preheat zone | Gigacalories | N |

In the absence of the dam, the residence time of a given volume of charge in the preheat zone of a kiln designed in accordance with the given parameters would be about 1.05 hours. However, with the intermediate dam in place, this average residence time may typically be increased to 2.15 hours. It will be seen that this increase in average residence time reduces the required heat transfer rate in the zone from N/1.05 Gcal/hr to N/2.15 Gcal/hr. Thus, the heat transfer rate requirement may be reduced by a factor of (1.05:215)=0.488:1 or about 50%.

In addition to the reduction in heat transfer rate, the overall heat flux requirement is reduced by virtue of the increase in the available surface area of the bed for heat transfer. For example, if it is considered that the width of the surface of the bed subtends a 90° angle centered on the axis within the kiln and the kiln has a radius R of 2.5 meters, the surface area of the bed will be approximately equal to 1.414 RL $m^2$, where L is the length of the bed in the preheat zone in meters. If it is considered further that in the absence of the dam the width line of the bed surface intersects a radius drawn perpendicularly to the two surfaces, at a point half way between the first surface and the circumference, the area of the surface without the dam will equal 1.0423 RL $m^2$ from the geometrical construction. The required heat flux values, with and without the dam therefore, will be respectively (N/2.15×1.414 RL)=N/3.0401 RL and (N/1.05×1.0423 RL)=N/1.0944 RL Gcal/hr/$m^2$.

Consequently, the ratio of the heat flux requirements with and without the dam will be 1.0944/3.0401 or 0.3599:1. Thus, the cumulative result of the two effects is that the heat flux requirement is about 36% of what it would be without the dam.

A further important consideration in this regard resulting from the use of the intermediate dam, is the change in the rate of heat transfer to the materials when passing over the dam. It will be seen that as the bed material actually passes over the upper surface or lip of the intermediate dam 23, the material goes from a very thick bed or volume immediately before the dam to a comparatively thin layer on the dam itself. Thus, while the surface area remains approximately the same, the bed volume is substantially decreased so that the available bed surface area per unit of mass through which heat may be transferred in this region is increased by a large factor. As a result, the rate of heat transfer from gases to solids in this region is greatly enhanced. Further, on the downstream side of the intermediate dam, because of the inclination of the kiln, the advancing or falling layer of material lands on and combines with another comparatively thin layer of bed so that the materials again gain additional sensible heat which contributes to bringing them ultimately up to the reduction temperature. In any event, since in the region immediately beyond the dam, the transition region, the temperature of the kiln bed, with proper control of the temperature profile in the kiln, will still be below that at which the reduction reactions are occurring rapidly, the heat demand of the bed will still be low. However, as this transition region is located at the beginning of the reduction zone, the potential is present to have very high gas temperatures generated so that it becomes important that the rate of rise in temperature in this region be depressed and closely controlled to avoid high heat transfer to the bed with consequent rapid sintering. This is accomplished by the controlled addition of combustion air into the freeboard gases above the transition region and the preheat zone in a manner such as disclosed in U.S. Pat. No. 4,273,314, assigned to the same assignee as the present application.

In particular, as shown in FIG. 1, by reversing the three air tubes 9 in the preheat zone, the amount of combustion air being injected into the freeboard over the transition region can be minimized by simply limiting the air injected through the two air tubes in that region. At the same time, larger air volumes can be injected by the air tubes in the preheat zone since this combustion air is directed to travel with the exhaust gas flow out of the kiln. This air tube arrangement then permits the injection of increased combustion air volumes into the preheat zone to enhance the heat transfer to the bed in that zone without disturbing the control of the heat transfer in the transition region where control is critical. The increased heat provided by the increased air injection can be used to roast off as much sulphur as possible from the feed end coal and maximize burning of the coal volatiles in the freeboard above the charge bed in the preheat zone and thus optimize process performance. This capability is another factor taken into consideration in designing the intermediate dam.

It will then be appreciated by those skilled in the art that proper use of the dam in combination with gas and bed temperature control using injected combustion air, permits the pumping of heat into the bed in a highly efficient manner so that the charge materials entering the kiln at ambient temperature may be expeditiously but carefully brought up to the proper temperature levels in the preheat zone and enter the reduction zone at an early point in their travel along the kiln, thus maximizing the use of kiln volume in performing the process.

It is contemplated that when designing for certain combinations of charge materials, an intermediate dam arrangement using a single dam such as shown in FIG. 1 may not be found suitable so that one or more additional dams may be used, such as illustrated in FIG. 2.

For example, if the height required for a single intermediate dam is such as to limit the cross-sectional area of the kiln interior at the dam beyond that required for the passage of the gases therethrough and out of the kiln, then the use of two dams of reduced height to achieve the same total volume filling may be found feasible. In such instances the spacing, heights, and dimensions of the intermediate dams 23*a* and 23*b* will be adjusted to achieve the desired volume filling. It will be within the purview of those skilled in the art using the foregoing descriptions to determine the appropriate design parameters for the particular constituent materials to be used in the process.

The appropriate and preferred temperature profiles for iron ores and other iron oxide materials, similar to those disclosed in previously-noted U.S. Pat. No. 4,304,597, are such that the temperature in the bed in the preheat zone increases to a maximum of about 750° C. to 800° C. and in the transition region downstream of the intermediate dam the temperature is elevated slowly through about a further 75° C. to 125° C. until reaching the start of the working zone where the reduction reactions begin to occur rapidly. The charge temperature is thereafter increased rapidly to a constant maximum ranging from about 925° C. to 1075° C., depending upon the characteristics of the constituents and the desired product specifications, throughout the working zone all the way to the discharge end of the kiln.

In addition to the sensible heating of the preheat zone bed materials, principally by radiant heat from the passing hot gases generated in the reduction zone, there are endothermic phenomena that occur in the preheat zone so that chemical heat as well as sensible heat are required to be supplied. Heat is absorbed in the calcining of the limestone or dolomite, in evaporating water in the feed materials, and in the devolatilizing of the carbonaceous materials. Control of this devolatilizing in a steady manner is important to obtain progressive release and utilization of the chemical heat of the volatiles within the kiln. The extended residence time and controlled temperature rise achievable in the preheat zone with the intermediate dam allows this to be carried out. Appropriate control is achieved as previously-indicated by regulating the volume of air that is injected into this zone. With proper air volume regulation, the volatiles rising from the bed may be partially burned in a steady controlled fashion such that the gas temperatures are increased and maintained at a high enough level to produce the necessary heat transfer rates. At the appropriate gas temperature levels, above about 750° C. to 800° C., heat transfer is largely radiative and the rate is proportional to the difference between the fourth powers of the gas and bed temperatures. Again, the increased residence time of the bed materials in the preheat zone, due to the intermediate dam, provides adequate time to absorb additional heat given off by burning of the volatiles in this zone.

Combustion of the volatiles from the preheat zone bed should be as complete as possible not only for the production of additional heat but also for eliminating the production of pollutants by the process. More particularly, in order to avoid or minimize any stack gas pollution resulting from the incomplete combustion of CO and hydrocarbons in the kiln off-gases, the temperature of the gases at the kiln exit should be maintained above about 750° C. Under this condition, any required after-burning can be accomplished by the simple addition of the required volumes of ambient air into the exhaust gas ducting. For most charge constituents, the process will be run with exhaust gases exiting the kiln at about 800° C. to 850° C. so that the temperature of the gas in the ducting will be maintained above the 750° C. level. This temperature maintenance will permit adequate after-burning to occur even though there are temporary drops in the gas temperature by 100° C. or more. A conventional water spray system may be used at the feed end of the kiln to assist in controlling the exhaust gas temperature.

It is possible to produce the 75° C. to 125° C. rise in temperature within the materials bed in the transition region without varying the gas temperature in the region since the surface area to mass variation will automatically produce the increase. While a rise in gas temperature need not necessarily be produced, still it can be utilized if adequate preheating of the bed materials is not occurring in the preheat zone; a condition which would normally indicate that a larger proportion of the kiln length is needed. The combustion air injection may be adjusted to regulate the hot gas flow above the dam to produce the appropriate heat.

Also, in the event that the materials are not brought to the desired temperature level at the end of the preheat zone due to inadequate heating or design, a temperature rise to the desired level may be accomplished by controlling the injection of the carbonaceous material from pipe 8 at the discharge end in combination with air injection through the shell tubes 9. The carbonaceous material may be blown onto the surface of the bed beyond the dam into the preheat zone to provide additional volatiles for combustion to produce an increase in the gas temperature above the bed. This material may also act to supply additional carbon to the bed to provide char to this region particularly when no char is fed at the feed end.

Briefly then, optimum operation may be achieved by controlling the bed temperature in the preheat zone such that the materials are at a temperature of about 750° C.–800° C. at the intermediate dam 23 and thereafter the temperature is increased by about 75° C. to 125° C. in the transition region immediately beyond the dam by creating the appropriate heat transfer rate in this area. The materials will then leave the transition region and enter the working zone at a temperature of about 825° C. to 925° C., which has been found to be desirable in achieving proper control and optimum operation of the process.

During kiln operation, once the optimum design has been completed, to ensure that maximum volume filling in the preheat zone is being maintained, a simple monitoring method may be used which is capable of being performed by an unskilled operator. The method involves the establishment of a small but definite material spillback mass flow over the feed end lip of the kiln. To this end, the rotational speed of the kiln and the rate of charge feed are adjusted such that a small amount of material spills back over the lip of the feed end dam 21 indicating that the charge is entering the kiln faster than the rotational speed can move it along within the kiln. The small amount of spillback is maintained at a constant level by maintaining the feeding and rotation of the kiln at constant levels. This small spillback will indicate that the maximum volume of materials is being supplied to the kiln and thus that the kiln is operating at full capacity and providing maximum residence time for the materials in the preheat zone of the kiln. The spillback materials may be readily recycled and it is a simple matter for an operator to maintain the charge feed spill-back and kiln rotational rates constant during process operation. It will also be seen that without an intermediate dam arrangement, there is no defined separation of the preheat and reduction zones in the kiln, that is, no readily identifiable place in the kiln indicating where metallization of the metal oxides is actually beginning. With such a dam, after process operation is suitably established, there is a defined line of demarcation which can be used to enhance process control.

The dams may be of castable or monolithic refractory construction or of refractory brick as will be found desirable or convenient in a particular situation. The creation of an intermediate dam by means of sinter accretion build-up is possible but not preferred.

What is claimed is:

1. In an inclined rotary kiln of the type for directly reducing metal oxides using a solid carbonaceous material as the source of fuel and reductant, and having an opening at the higher end for receiving the metal oxides materials as a charge along with a portion of the solid carbonaceous materials, and an opening at the lower end for receiving the remainder of the solid carbonaceous materials and for discharging the reduced materials therefrom and wherein the kiln interior wall defines a process operating zone bounded by a feed end dam located at the higher end of the kiln and a discharge end dam located at the lower end through which zone the bed of charge materials moves, the improvement comprising:

intermediate dam means, disposed within the kiln between the feed end and discharge end dams at a location about one-third the distance along the length of the kiln from the feed end dam, for dividing the operating zone into a preheat zone between said dam means and the feed end dam and a reduction zone between said dam means and the discharge end dam, said dam means being dimensioned to provide volume filling and residence time of the bed materials in said preheat zone sufficient to permit the transfer of adequate heat thereto at the available rate of heat transfer through the surface of the bed in said preheat zone to raise the temperature of the materials to a level approaching the reduction temperatures of the metal oxides by the time the materials reach the end of said preheat zone in their movement through the kiln.

2. A kiln as in claim 1 wherein said intermediate dam means comprises a plurality of annular dams.

3. A kiln as in claim 1 further comprising a plurality of means, spaced from each other along the kiln length, for injecting oxygen-containing gas axially within the kiln, each of said injecting means on the feed end side of said dam means being directed to inject said gas toward the feed end and each of said injecting means on the discharge end side of said dam means being directed to inject said gas toward the discharge end.

4. A method for optimizing the product metallization and throughput capacity of an inclined rotary kiln with a given interior volume, directly reducing metal oxides using solid carbonaceous materials as the source of fuel and reductant, a portion of which carbonaceous materials is fed as a charge together with the metal oxides into the kiln through a feed opening at the higher end thereof, and the remainder of which is fed through a discharge opening at the lower end of the kiln out of which the reduced materials are discharged, comprising the steps of:

forming an intermediate dam structure within the kiln between the feed opening and discharge opening at a location about one-third the distance along the length of the kiln from the feed opening for defining a region in the kiln wherein the charge bed moving through the kiln is preheated to a temperature approaching that at which the metal oxides are reduced; and setting the dimensions of the intermediate dam structure with respect to the feed opening to create a charge bed depth in the defined region between the end of the dam structure and the feed opening, for providing a volume filling and retention time of the materials in said region of the bed sufficient to raise the temperature of the materials upon reaching the end of the dam structure to a level approaching the reduction temperature of the metal oxides at the available heat transfer rate at the surface of the bed in said region.

5. The method of claim 4 comprising the further steps of:

injecting oxygen-containing gas at spaced intervals axially along the length of the kiln;

directing said gas injected on the feed opening side of the dam structure toward the feed opening; and directing said gas injected on the discharge opening side of the dam structure toward the discharge opening.

6. The method of claim 5 comprising the further step of injecting an amount of said gas toward the feed opening to maintain the temperature of the gas exiting through the opening above about 750° to facilitate afterburning with ambient air.

7. The method of claim 4 wherein said dam structure is formed as a plurality of annular dams.

8. The method of claim 4 wherein the location and dimensions of said dam structure are determined as a function of the particular metal oxides and carbonaceous materials to be used in the charge bed.

9. The method of claim 4 comprising the further steps of adjusting the rotational speed of the kiln and the rate of charge feed such that a small amount of charge material spills back out of the kiln through the feed opening consistently during kiln operation.

10. The method of claim 4 wherein said dam structure is located as close to the feed opening as feasible to maximize the length of the kiln between said dam structure and said discharge opening.

* * * * *